United States Patent [19]

Wyzykowski

[11] Patent Number: 4,696,473

[45] Date of Patent: Sep. 29, 1987

[54] GAME PACKAGE FOR CONFECTIONS

[76] Inventor: Casmere J. Wyzykowski, 6425 S. Gessner, #2179, Houston, Tex. 77036

[21] Appl. No.: 826,002

[22] Filed: Feb. 4, 1986

[51] Int. Cl.[4] ..... A63F 9/06

[52] U.S. Cl. ..... 273/153 R; 273/157 R

[58] Field of Search ..... 273/153 R, 157 R

[56] References Cited

U.S. PATENT DOCUMENTS

| | | | |
|---|---|---|---|
| 1,274,294 | 7/1918 | Lobl | 273/153 S |
| 1,592,252 | 7/1926 | Beckwith | 273/153 R |
| 2,544,961 | 3/1951 | Kemp | 273/153 R |
| 4,512,581 | 4/1985 | Levine | 273/153 R |

FOREIGN PATENT DOCUMENTS

| | | | |
|---|---|---|---|
| G8126065.2 | 6/1982 | Fed. Rep. of Germany | 273/153 S |
| 1294259 | 10/1972 | United Kingdom | 273/260 |

OTHER PUBLICATIONS

"Pruzzle", Washington Daily News, Mar. 20, 1967, p. 52.

*Primary Examiner*—Anton O. Oechsle

*Attorney, Agent, or Firm*—Neal J. Mosely

[57] ABSTRACT

A package for confections containing a game using this confections as playing pieces comprises a plurality of individual playing piece confections capable of being consumed by the player, some of which display letters of the alphabet, and a playing surface having series of crossing lines defining a grid containing a plurality of similar enclosed spaces slightly larger than the confections. The spaces on the grid may be all blank for construction of a message thereon with the lettered confection pieces or may have selected spaces marked with letters forming a part of a message to be completed by placing of selected lettered confection pieces on unmarked spaces aligned therewith. The game package container encloses the playing piece confections, the playing surface, and an answer sheet secreted from the player containing the correct completed phrase. Alternatively, a second playing surface may be included with the package having a grid on which a person other than the player may superimpose letters of the alphabet to form a predetermined phrase whereby the phrase is determined by the other person and initially unintelligible and unknown to the player.

15 Claims, 6 Drawing Figures

GAME PACKAGE FOR CONFECTIONS

BACKGROUND OF THE INVENTION

1. Field of the Invention

This invention relates generally to packages and containers, and more particularly to a package for confections containing a game using the confections as playing pieces.

2. Brief Description of the Prior Art

Confectionery gift items are known such as candy-letters which consist of a box of candies with a personal card or letter enclosed which may be mailed others. It has also been known to make chocolate reproductions of various items including popular board games such as Monopoly.

Crossword puzzles and anagram games are known wherein words or phases are formed by the puzzel solver by responding to a given definition and adding the corresponding word in a row or column or adding one or more letters in sequence in a number of different directions to form words of their choice. There are several patents which disclose various word puzzle games.

James, U.S. Pat. No. 4,185,830 discloses a word puzzle game wherein a base is provided with plurality of rows of letters and punctuation symbols at fixed locations in the rows. A plurality of template outlines of various shapes are located in fixed positions among the letters and punctuation marks. A plurality of letter bearing movable elements of corresponding shape and size to the templates are superimposed in registry whereby the letters form a completed predetermined phrase.

Smith, U.S. Pat. No. 3,396,972 discloses a game apparatus having a numerical scoring feature. Individually colored and lettered game pieces or tiles are employed to construct words on a game board. The tiles coact with both printed and colored indicia on the game board to produce a score possibility on every move during the course of play.

Moss, U.S. Pat. No. 3,053,537 discloses a word building game having a plurality of game pieces, some bearing a single letter, some two letters, and others having three letters. The pieces are provided with a rotatable carrier for the letters whereby the sequence of the letters may be reversed.

Trbojevich, U.S. Pat. No. 1,629,601 discloses an improvement in the well known crossword puzzle game wherein the black squares are replaced with a system of heavy vertical and horizontal lines to separate the words from each other.

British Pat. No. 885,340 discloses a word race game wherein each player has a playing surface divided into squares some of which are plain and others are colored or contain a letter. The squares extend from a starting point to a finish point. The roll of a die determines the letters to be inserted in the plain squares so as to form, with letters already provided, complete words.

The present invention is distinguished over the prior art in general, and these patents in particular by providing a package for confections which contains a game utilizing the confections as playing pieces and which may be consumed by the player after using them to complete a selected phrase.

The package includes a plurality of individual playing piece confections, some of which display letters of the alphabet, and a playing surface having series of crossing lines defining a grid containing a plurality of similar enclosed spaces slightly larger than the confections. Some of the spaces display letters of the alphabet arranged in a pattern to form a predetermined phrase when filled in with additional letters whereby the phrase is initially unintelligible and unknown to the player. Certain of the lettered confections when positioned by the player on the grid in initially blank spaces complete the initially unknown phrase.

The game package container encloses the playing piece confections, the playing surface, and an answer sheet secreted from the player containing the correct completed phrase. Alternatively, the playing surface may be provided with blank spaces, or a second playing surface included with the package having a grid on which another person may superimpose letters of the alphabet to form a custom personalized phrase created by the other person and initially unintelligible and unknown to the player or person receiving the package.

SUMMARY OF THE INVENTION

It is therefore an object of the present invention to provide a novel gift package for confections which is enjoyable as delicious treat, an entertaining game, and contains a secret message for the recipient.

It is another object of this invention to provide a package for confections which contains a game utilizing the confections as playing pieces and which may be consumed by the player after using them to complete a selected phrase.

Another object of this invention is to provide a package for confections which contains a game wherein some of the confections display letters of the alphabet, and a playing surface having series of crossing lines defining a grid of similar enclosed spaces on which the lettered confection pieces are to be played to produce a selected phrase or message.

Another object of this invention is to provide a novel gift package for confections which contains a game utilizing the confections as playing pieces and a playing surface on which the sender may superimpose letters of the alphabet to create a custom personalized phrase or message which is initially unintelligible and unknown to the recipient of the package.

A further object of this invention is to provide a package for confections which contains a work game having a phrase or message commemorative of a special occasion relating to the recipient and container boxes printed in graphics suitable for the occasion.

A still further object of this invention is to provide a game package for confections which is attractive in appearance, inexpensive to manufacture, and suitable for mailing.

Other objects of the invention will become apparent from time to time throughout the specification and claims as hereinafter related.

The above noted objects and other objects of the invention are accomplished by a package for confections which contains a game utilizing the confections as playing pieces and which may be consumed by the player after using them to complete a predetermined phrase. The package includes a plurality of individual movavle playing piece confections, some of which display letters of the alphabet, and a playing surface having series of crossing lines defining a grid containing a plurality of similar enclosed spaces slightly larger than the confections. Some of the spaces display letters of the alphabet arranged in a pattern to form a predetermined phrase absent a plurality of letters whereby the phrase is initially unintelligible and unknown to the player. Certain ones of the confections which display letters when collocated on the grid by the player complete the initially unknown phrase. A game package container encloses the playing piece confections, the playing surface, and an answer sheet secreted from the player containing the correct completed phrase.

Alternatively, the playing surface may be provided with blank spaces, or a second playing surface included with the package having a grid on which a person other than the player may superimpose letters of the alphabet to form a custom personalized phrase created by the other person and initially unintelligible and unknown to the player or person receiving the package.

DESCRIPTION OF THE PREFERRED EMBODIMENT

Figure 1:
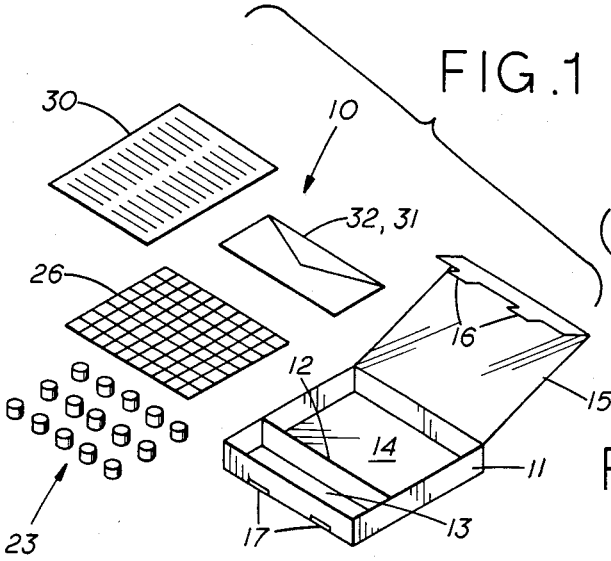
FIG. 1 is an exploded isometric view of a game package for confections having a generally square box container.

Referring to the drawings by numerals of reference there is shown in FIG. 1, a package for confections containing a game using the confections as playing pieces. The package assembly 10 shown in FIG. 1 is enclosed in a generally square box container 11 having a divider 12 which divides the box into a confection receiving area 13 and a storage area 14. The lid 15 of the box container 11 has tabs 16 which are received into slots 17 provided in one side wall for securing the contents therein.

Figure 2:
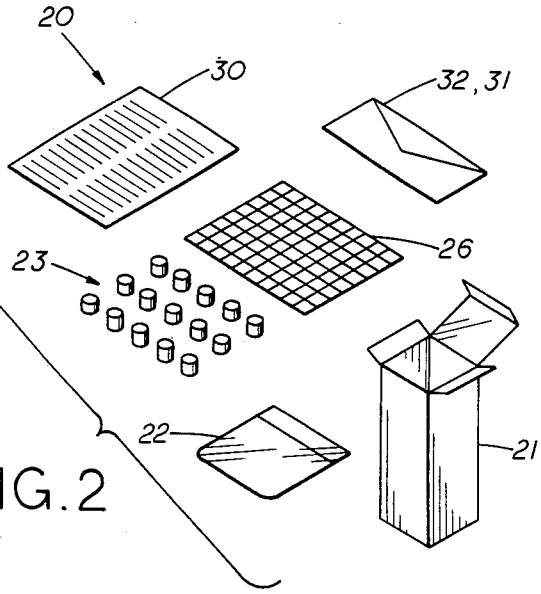
FIG. 2 is an exploded isometric view of a game package for confections having a generally rectangular box container.

The package assembly 20 shown in FIG. 2 is enclosed in a generally rectangular box container 21 having a sealable plastic bag 22 which receives the confections. The components of the assembly described hereinafter may be rolled and inserted into the rectangular box container 21 with the plastic bag 22 and tabs at the top of the container folded in a conventional manner to securing the contents therein.

The components of the game package of FIGS. 1 and 2 are the same with the exception of the plastic bag 22, however a plastic bag may also be used to enclose the confections before placing them into the confection area 13 of the box container 11 of the assembly illustrated in FIG. 1.

The components of the game package for confections comprises a plurality of individual playing piece confections 23. The confections may be of any suitable substance capable of being consumed by the player, such as hard candy, cookies, or chocolates.

Certain ones 24 of the confections 23 are lettered on their top surface as by printing during manufacture or the letters may be printed on a wrapper, for example in the use of chocolates. Other ones 25 of the plurality of confections may be unlettered or have a plain wrapper. All the confections are to be consumed by the player of the game after completing the game.

Figure 3:
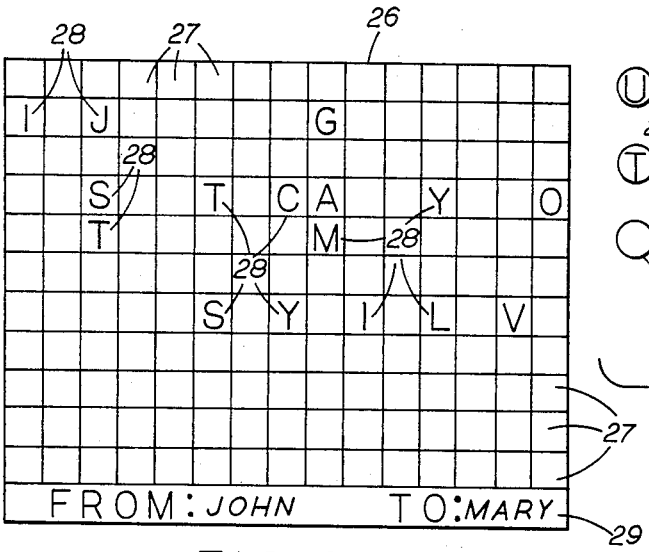
FIG. 3 is a front elevation of the playing surface of the game package in accordance with the invention.

A playing surface 26 of foldable or flexible material is imprinted with a series of crossing lines defining a grid containing a plurality of similar enclosed spaces 27 slightly larger than the playing piece confections 23. Certain ones of the spaces 28, as shown in FIG. 3, may be imprinted with letters of the alphabet arranged in a pattern to form a predetermined phrase or message when completed by placing the lettered confection pieces on selected blank spaces, which message or phrase is initially unintelligible and unknown to the player.

Figure 4:
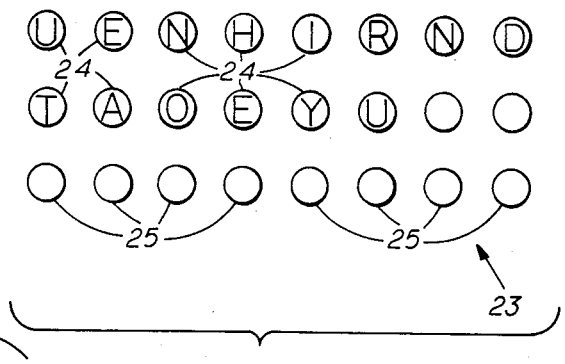
FIG. 4 is a top plan view of a plurality of the playing piece confections of the present invention.
Figure 5:
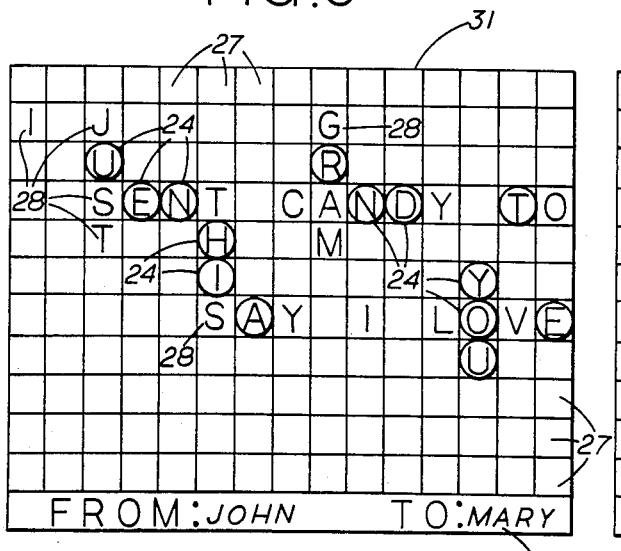
FIG. 5 is a front elevation of the playing surface having a typical phrase completed thereon by the playing piece confections.
Figure 6:
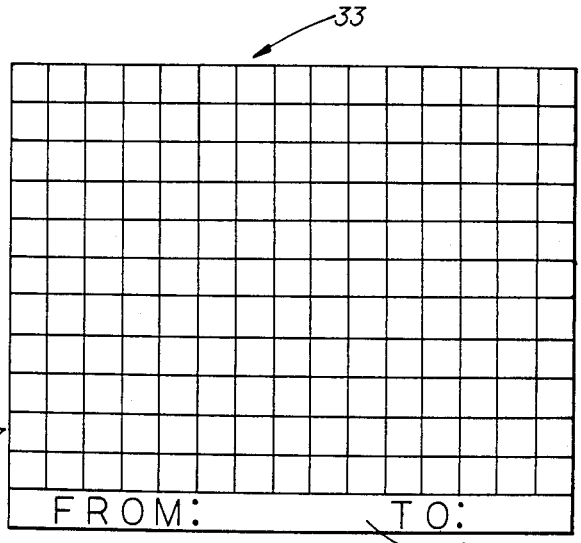
FIG. 6 is a front elevation of and alternate playing surface of the game package having blank spaces to receive letters of the alphabet.

The playing surface 26 may have a space at the bottom 29 for application of the name of the person presenting the game package and the name of the person who is to receive the package and play the game. As shown in FIGS. 4 and 5, certain lettered playing piece confections 24 when properly positioned on the grid by the player complete the initially unknown phrase.

A set of instructions 30 is included in the package for instructing the player to fill the spaces which are absent the letters with the playing piece confections 24 displaying the letters. The instructions may also be printed on the container. The solution to the phrase is shown in FIG. 5. The solution is illustrated on an answer sheet 31 containing the correct completed phrase. The answer sheet 31 is secreted from the player by enclosing it in an envelope 32 (FIGS. 1 and 2).

The phrase to be completed may be commemorative of a special occasion, such as message relating to "Happy Birthday," "Happy Anniversary", or "I Love You". The container boxes 11 and 21 would also be printed in graphics suitable for the occasion.

Alternatively, the surface face may be provided with blank spaces, or a second playing surface 33 may be included with the package assembly having a grid on which a person other than the player may superimpose letters of the alphabet to form a predetermined "customized" phrase whereby the phrase is determined by the other person and initially unintelligible and unknown to the player. The other person may make up their own personalized phrase or message by designing their own playing surface arrangement. If the blank playing surface is included as an additional component, the person receiving the original package may use it to respond to the first message.

While this invention has been described fully and completely with special emphasis upon a preferred embodiment, it should be understood that within the scope of the appended claims the invention may be practiced otherwise than as specifically described herein.

I claim:

1. A game package for packaging and sale of confections comprising;

a container, a plurality of individual edible playing piece confections having selected letters of the alphabet displayed thereon, a playing surface having series of crossing lines defining a grid containing a plurality of similar enclosed spaces each slightly larger than said playing piece confections, said playing piece confections having precisely the letters required to form a selected message or phrase which is initially unintelligible and unknown to the player, at least one of said spaces displaying a letter of the alphabet forming part of a predetermined message or phrase, which is initially unintelligible and unknown to the player, by positioning selected playing pieces in selected unmarked spaces, a set of instructions for instructing the player to place the lettered playing piece confections in the spaces on the playing surface, an answer sheet secreted from the player containing the correct completed phrase or message, and said container enclosing said playing piece confections, said playing surface, said set of instructions and said answer sheet.

2. A game package for packaging and sale of confections comprising;

a container, a plurality of individual edible playing piece confections having selected letters of the alphabet displayed thereon, a playing surface having series of crossing lines defining a grid containing a plurality of similar enclosed spaces each slightly larger than said playing piece confections, said playing piece confections having precisely the letters required to form a selected message or phrase which is initially unintelligible and unknown to the player, a set of instructions for instructing the player to place the lettered playing piece confections in the spaces on the playing surface, an answer sheet secreted from the player containing the correct completed phrase or message, and said container enclosing said playing piece confections, said playing surface, said set of instructions and said answer sheet, a second playing surface having series of crossing lines defining a grid containing a plurality of similar enclosed spaces slightly larger than said playing piece confections, whereby some of said spaces may receive letters of the alphabet superimposed thereon by a person other than the player and arranged in a pattern to form a predetermined phrase, determined by said person and initially unintelligible and unknown to the player, on placing selected playing pieces in selected unmarked spaces.

3. A game package for packaging and sale of confections according to claim 1 in which;

said predetermined phrase or message is commemorative of a special occasion, and said said container displays graphics suitable for said occasion.

4. A game package for packaging and sale of confections according to claim 1 in which;

said plurality of individual playing piece confections have an outer wrapper, and the letters displayed on said individual playing piece confections are borne by said wrapper.

5. A game package for packaging and sale of confections according to claim 1 in which;

said plurality of individual playing piece confections have said selected letters imprinted directly thereon.

6. A game package for packaging and sale of confections according to claim 1 in which;

said plurality of individual playing piece confections have said selected letters physically formed therein.

7. A game package for packaging and sale of confections comprising;

a plurality of individual edible playing piece confections, some of which display letters of the alphabet, a playing surface having series of crossing lines defining a grid containing a plurality of similar enclosed spaces slightly larger than said playing piece confections, some of said spaces displaying letters of the alphabet arranged in a pattern to form a predetermined message or phrase, which is initially unintelligible and unknown to the player, by positioning selected playing pieces in selected unmarked spaces, a set of instructions for instructing the player to fill the unmarked spaces with selected playing piece confections, an answer sheet secreted from the player containing the correct completed phrase, and a container for enclosing said playing piece confections, said playing surface, said set of instructions and said answer sheet.

8. A game package for packaging and sale of confections according to claim 7 further comprising;

a second playing surface having series of crossing lines defining a grid containing a plurality of similar enclosed spaces slightly larger than said playing piece confections, whereby some of said spaces may have selected letters placed thereon by a person other than the player and arranged in a pattern to form a selected message or phrase, determined by said other person and initially unintelligible and unknown to the player, on positioning selected playing pieces in selected unmarked spaces.

9. A game package for packaging and sale of confections according to claim 7 in which;

said predetermined phrase or message is commemorative of a special occasion, and said said container displays graphics suitable for said occasion.

10. A game package for packaging and sale of confections according to claim 7 in which;

said plurality of individual playing piece confections have an outer wrapper, and the selected letters displayed on said playing piece confections are on said wrapper.

11. A method of packaging of confections for sale and use in a game comprising the steps of;

providing a plurality of edible confections for use as playing piece in a game, providing selected ones of said confections with letters of the alphabet, providing a game playing surface having series of crossing lines defining a grid containing a plurality of similar enclosed spaces slightly larger than said confections, imprinting some of said spaces with letters of the alphabet arranged in a pattern to form a selected message or phrase, initially unintelligible and unknown to the player, on placing selected lettered playing pieces in selected unmarked spaces, providing a set of instructions for instructing the player to fill the unmarked spaces with said playing piece confections, providing an answer sheet secreted from the player containing the correct completed phrase, and enclosing said playing piece confections, said playing surface, said set of instructions, and said answer sheet within a container

12. A packaging method according to claim 11 further comprising the step of;

providing a second playing surface having series of crossing lines defining a grid containing a plurality of similar enclosed spaces slightly larger than said confections, providing a set of instruction for instructing a person other than the player to place selected letters of the alphabet on said grid in a pattern to form a selected message or phrase, initially unintelligible and unknown to the player, when completed by placement of selected lettered playing pieces on selected unmarked spaces.

13. A packaging method according to claim 11 comprising the further steps of;

imprinting said container with graphics commemorative of a special occasion.

14. A packaging method according to claim 11 comprising the further step of;

wrapping a number of said confections in a wrapper imprinted with a letter of the alphabet and wrapping other ones of said confections in a wrapper without letters of the alphabet.

15. A packaging method according to claim 11 comprising the further step of;

printing or forming said selected letters in said lettered confections.

* * * * *